US006152125A

United States Patent [19]

Piper

[11] Patent Number: 6,152,125

[45] Date of Patent: Nov. 28, 2000

[54] MULTI-BARRELED RAPID FIRE BB GUN

[76] Inventor: Paul A Piper, P.O. Box 95, Lamposas, Tex. 76550

[21] Appl. No.: 09/221,440

[22] Filed: Dec. 28, 1998

[51] Int. Cl.[7] ..... F41B 11/06; F41B 11/02

[52] U.S. Cl. ..... 124/59; 124/72; 124/82

[58] Field of Search ..... 124/59, 72, 82

[56] References Cited

U.S. PATENT DOCUMENTS

| | | | |
|---|---|---|---|
| 4,073,280 | 2/1978 | Koehn et al. | 124/72 |
| 4,083,349 | 4/1978 | Clifford | 124/72 |
| 4,108,272 | 8/1978 | Paitson et al. | 181/120 |
| 4,137,893 | 2/1979 | Beauchamp | 124/72 |
| 5,054,464 | 10/1991 | Young | 124/72 |
| 5,282,455 | 2/1994 | Adamson et al. | 124/59 |
| 5,596,978 | 1/1997 | Johnson | 124/72 |
| 5,699,781 | 12/1997 | Johnson et al. | 124/72 X |

*Primary Examiner*—Robert P. Swiatek
*Attorney, Agent, or Firm*—Michael I. Kroll

[57] ABSTRACT

A multi-barreled rapid fire gun and method of use for firing a plurality of projectiles contained within a container releasably connected to the gun. The gun includes at least one barrel for receiving the projectiles from the supply. A supply of gas is connected to the at least one barrel and a device for providing gas from the supply to the at least one barrel is connected therebetween. A gas regulator is provided for regulating a pressure of the gas supplied to the at least one barrel wherein activation of the device for providing causes the gas to be supplied to tie at least one barrel to be received at a desired pressure causing the projectile to be ejected from the at least one barrel, a velocity at which the projectile is ejected and a distance at which the projectile travels being dependent upon the pressure at which the gas is provided to the at least one barrel. The multi-barreled rapid fire gun may include a plurality of barrels and a rotational motor for rotating the plurality of barrels wherein each barrel receives a projectile to be ejected therefrom from the supply of projectiles upon each revolution. The barrels are fed the projectiles through a feedway extending around the barrel housing from which the plurality of barrels extend. The projectiles are drawn into each barrel by a bolt having a magnetic tip for attracting the projectiles which is caused to extend into the barrel prior to ejection of the projectile.

17 Claims, 9 Drawing Sheets

MULTI-BARRELED RAPID FIRE BB GUN

BACKGROUND OF THE INVENTION

1. Field of the Invention

The present invention relates generally to guns and, more specifically, to a rapid fire gun or rifle having a plurality of rotating barrels each of which ejects a BB through activation of a gas regulator causing a discharge of pressurized gas for propelling the BB.

2. Description of the Prior Art

Numerous types of guns and rifles have been provided in the prior art. For example, U.S. Pat. Nos. 4,083,349; 4,108,272; 5,054,464; and 5,596,978 all are illustrative of such prior art. While these units may be suitable for the particular purpose to which they address, they would not be as suitable for the purposes of the present invention as heretofore described.

A rapid-fire B.B. pellet-type machine gun operated from a source of gas propellant preferably a canister of liquefied gas, has a trigger-operated valve releasing propellant gas from the source to a pellet containing magazine for projecting the pellets in rapid succession through a barrel passageway to be ejected from the gun at high speed at a target to which the gun is pointed. The pellets underlie and surround a sleeve in the magazine acting as a cofferdam to maintain a local level of the pellets below the gas inlet and the gas outlet so that the gas will impinge against and actuate the pellets causing them to be successively swept into the gas outlet for discharge through the barrel.

A rapid-fire air gun for generating acoustic pulses in a body of water including a reservoir of high-pressure air, a shut-off valve, and a throttle valve for admitting air to an attached firing chamber. The firing chamber has an exhaust port that is sealed by a spring loaded exhaust valve. When the shutoff valve is open, high pressure air is admitted to the firing chamber through the throttle valve at a rate depending upon the effective aperture through the throttle valve. The exhaust valve is set to open at some selected pressure and to close at some lower pressure. When the air pressure in the firing chamber exceeds the pressure setting of the exhaust valve, the valve opens to impulsively release a jet of high pressure air which generates an acoustic pulse. When the air pressure in the firing chamber drops, the valve closes and the air pressure again fills up in the firing chamber. A series of such openings and closings generates a pulse train. The pulse repetition rate, that is the frequency of the pulse train. The pulse repetition rate, that is the frequency of the pulse train, depends on the throttle valve setting and/or the tension of the exhaust valve load spring.

A rapid fire gas powered projectile gun is comprised of a projectile holder; a barrel connected to the projectile holder having a diameter smaller than the diameter of the projectile holder but at least as large as the diameter of a projectile to be fired, so the projectile to be fired stops before the barrel because of its smaller diameter but is able to pass out of the barrel when pressure is applied to the projectile; a pressurization device connected to the projectile holder with the pressurization device fluidically connected to the projectile holder; a device for activating the pressurization device; a device for biasing located within the projectile holder and forcing any projectile in the projectile holder to be moved toward the barrel; and a trigger connected to the pressurization device in such a way that when the trigger is pulled pressure passes into the projectile holder forcing the projectiles out of the barrel.

An air compressed gun (10) is provided having a stock (11), a barrel (12), a trigger (13) and a manual air pump (14).

The gun also has a magazine (18) having a series of barrels (26) for holding several projectiles (P). An actuator (50) indexes the magazine with each shot of the gun and automatically actuates a release valve (36) which controls the firing of the gun.

SUMMARY OF THE PRESENT INVENTION

The present invention relates generally to guns and, more specifically, to a rapid fire gun or rifle having a plurality of rotating barrels each of which ejects a BB through activation of a gas regulator causing a discharge of pressurized gas for propelling the BB.

A primary object of the present invention is to provide a multi-barreled rapid fire BB gun that will overcome the shortcomings of prior art devices.

Another object of the present invention is to provide a multi-barreled rapid fire BB gun which is able to use a gas supply for propelling the BB's from the gun.

A further object of the present invention is to provide a multi-barreled rapid fire BB gun able to simulate the look and feel of a mini-gun when propelling the BB's using the supply of gas.

A yet further object of the present invention is to provide a multi-barreled rapid fire BB gun which is able to simulate the look and feel of a gatling gun when propelling the BB's using the supply of gas.

A still further object of the present invention is to provide a multi-barreled rapid fire BB gun which is able to be used for hunting or targeting.

An even further object of the present invention is to provide a multi-barreled rapid fire BB gun including a device for regulating the pressure of gas released and thus controlling the force at which the projectile is ejected from the gun.

A yet further object of the present invention is to provide a multi-barreled rapid fire BB gun including a device for adjusting the rate at which BBs are fired from the gun.

Another object of the present invention is to provide a multi-barreled rapid fire BB gun that does not have any carbon build-up or power residue.

Another object of the present invention is to provide a multi-barreled rapid fire BB gun that is simple and easy to use.

A still further object of the present invention is to provide a multi-barreled rapid fire BB gun that is economical in cost to manufacture.

Additional objects of the present invention will appear as the description proceeds.

A multi-barreled rapid fire gun and method of use for firing a plurality of projectiles contained within a container releasably connected to the gun is disclosed by the present invention. The gun includes at least one barrel for receiving the projectiles from the supply. A supply of gas is connected to the at least one barrel and a device for providing gas from the supply to the at least one barrel is connected therebetween. A gas regulator is provided for regulating a pressure of the gas supplied to the at least one barrel wherein activation of the device for providing causes the gas to be supplied to the at least one barrel to be received at a desired pressure causing the projectile to be ejected from the at least one barrel, a velocity at which the projectile is ejected and a distance at which the projectile travels being dependent upon the pressure at which the gas is provided to the at least one barrel. The multi-barreled rapid fire gun may include a plurality of barrels and a rotational motor for rotating the plurality of barrels wherein each barrel receives a projectile to be ejected therefrom from the supply of projectiles upon each revolution. The barrels are fed the projectiles through a feedway extending around the barrel housing from which the plurality of barrels extend. The projectiles are drawn into each barrel by a bolt having a magnetic tip for attracting the projectiles which is caused to extend into the barrel prior to ejection of the projectile.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
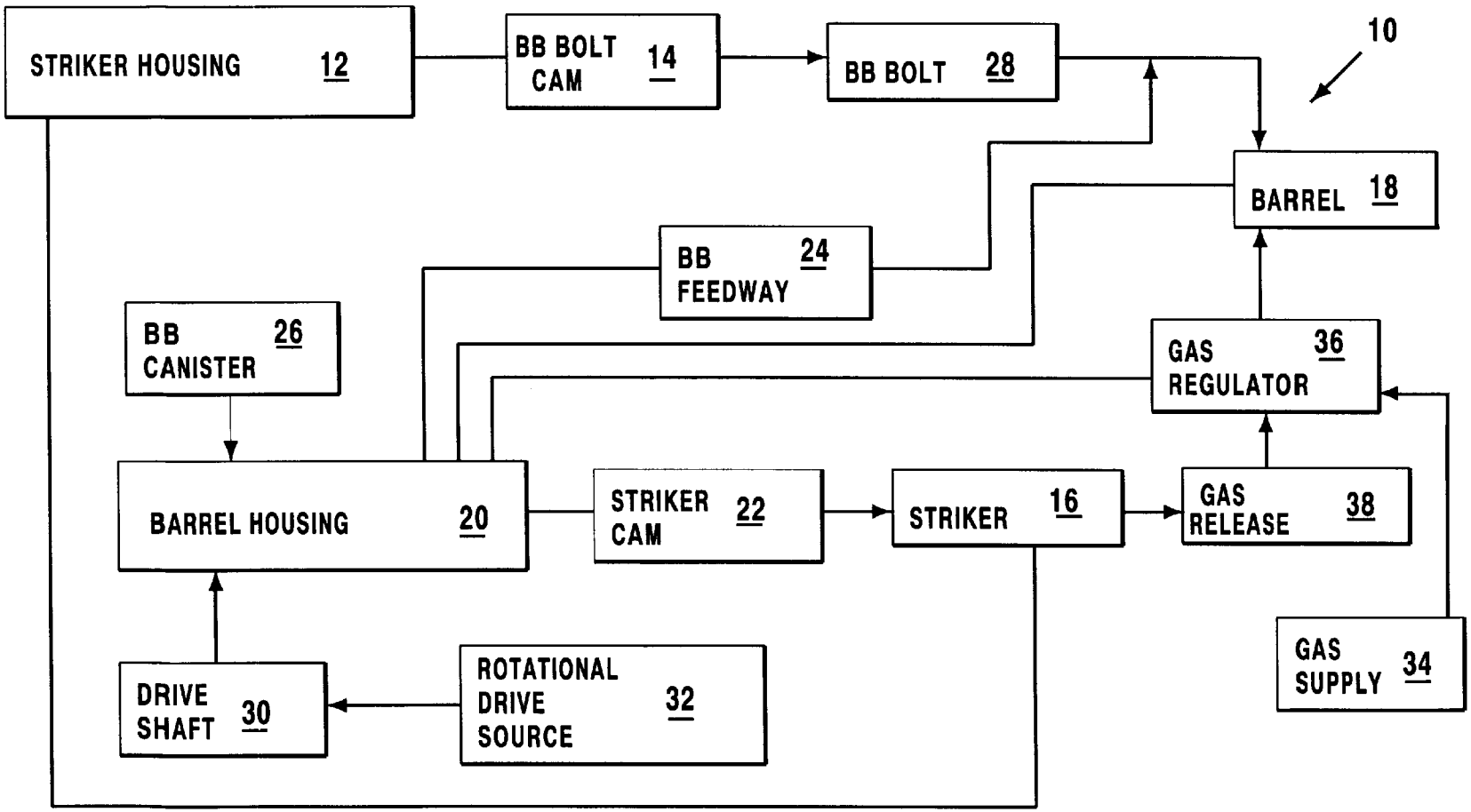
FIG. 1 is a block diagram of the multi-barreled rapid fire BB gun of the present invention.

Turning now descriptively to the drawings, in which similar reference characters denote similar elements throughout the several views, the Figures illustrate the multi-barreled rapid fire BB gun of the present invention. With regard to the reference numerals used, the following numbering is used throughout the various drawing figures.

10 multi-barreled rapid fire BB gun of the present invention
12 striker housing
14 BB bolt cam
16 striker
18 plurality of barrels
20 barrel housing
22 striker cam
24 BB feedway
26 BB canister
28 BB bolt
30 drive shaft
32 rotational drive source
34 gas supply
36 gas regulator
38 gas release
39 first end of barrel housing
40 barrel alignrent plate
42 plurality of recesses in barrel alignment plate
44 recess providing access to inside of barrel
46 groove forming BB feedway
48 plurality of recesses in groove
49 second end of barrel housing
50 adapter for connection of the gas supply
52 thread around one end of gas supply
54 passageway in canister for exiting of BB's
56 BB guide block
58 BB retainer
60 recess in gas regulator
62 gas release button
64 screws securing striker cam to barrel housing
66 plurality of recesses in striker cam for receiving gas release buttons
68 washers between striker cam and gas regulators
70 recess in central portion of striker cam for receiving drive shaft
72 spring
74 bell shaped curve/hump on BB bolt cam spring adjustment regulator
76 spring adjustment mechanism
78 saw tooth projections extending from striker cam
79 projectile of striker
80 spring of striker
82 frame
84 pulley drive
86 power source
88 handle
90 trigger
92 sight
94 manual rotational drive
96 hand crank
98 worm gear
100 unlimited propellant supply
102 gas source
104 flexible line
106 swivel coupling
108 limited mobile gas supply

DETAILED DESCRIPTION OF THE PREFERRED EMBODIMENT

Turning now descriptively to the drawings, in which similar reference characters denote similar elements throughout the several views, FIGS. 1 through 7 illustrate the multi-barreled rapid fire BB gun of the present invention indicated generally by the numeral 10.

A block diagram of the multi-barreled rapid fire BB gun 10 is illustrated in FIG. 1. The multi-barreled rapid fire BB gun 10 includes a striker housing 12 positioned at a first end of a frame and a barrel housing 20 is positioned on a second end of the frame. The striker housing 12 includes a BB bolt cam 14 and a striker 16 connected thereto. Connected to the barrel housing 20 and extending therefrom in a direction away from the striker housing 12 are a plurality of barrels 18. The barrel housing 20 includes a striker cam 22 and a BB feedway 24 and is positioned between the striker housing 12 and the plurality of barrels 18. The BB feedway 24 is a groove which extends around the circumference of the barrel housing 20 including a plurality of recesses extending therethrough, each of said plurality of recesses providing access to a respective one of said plurality of barrels 18.

A BB canister 26 is positioned atop the barrel housing 20 and a plurality of BB bolts 28 extend between the striker housing 12 and the barrel housing 20. The BB canister 26 includes a plurality of BB's positioned therein and a passageway through which the BB's may exit the canister 26. The passageway is aligned with the BB feedway 24 whereby any BB passing through the passageway will be received within the feedway 24. The plurality of BB bolts 28 are each aligned with a respective one of the plurality of barrels 18.

The barrel housing 20 is connected to a drive shaft 30 which is caused to rotate by a rotational drive source 32. The rotation of the drive shaft 30 causes the barrel housing 20 to rotate therewith. The BB bolts 28 are made of a magnetic material and rotate with the barrel housing 20. When each of the BB bolts 28 reaches the apex of the rotation they are positioned on a hump in the BB bolt cam 14 causing the BB bolts to extend one at a time into their respective barrel 18. The extension into the barrel 18 positions the magnetic material forming at least a tip of the BB bolt 28 directly below a recess in the feedway 24 and thereby applying an attractive force to a BB within the feedway 24. The attractive force causes a BB to be drawn into the barrel 18 through the recess.

A gas supply 34 is connected to the barrel housing 20 and a gas regulator 36 directs and regulates the flow of gas from the gas supply 34 into the BB feedway 24. Once a BB is positioned within the BB feedway 24, the striker cam 22 causes the striker 16 to extend or fire towards the barrel housing 20 and contact a gas release 38 on the gas regulator 36 causing pressurized gas to flow into the BB feedway 24 and fire the BB positioned therein through the barrel 18. The recess in the barrel 18 and the feedway 24 is blocked by the BB passing therethrough and thus the pressure applied by the gas entering the barrel 18 is not affected thereby. The pressure at which gas is supplied from the gas supply 34 to the barrel 18 is adjustable. The amount of pressure is determines the velocity at which the projectile will exit the barrel and the distance the projectile will travel.

Figure 6:
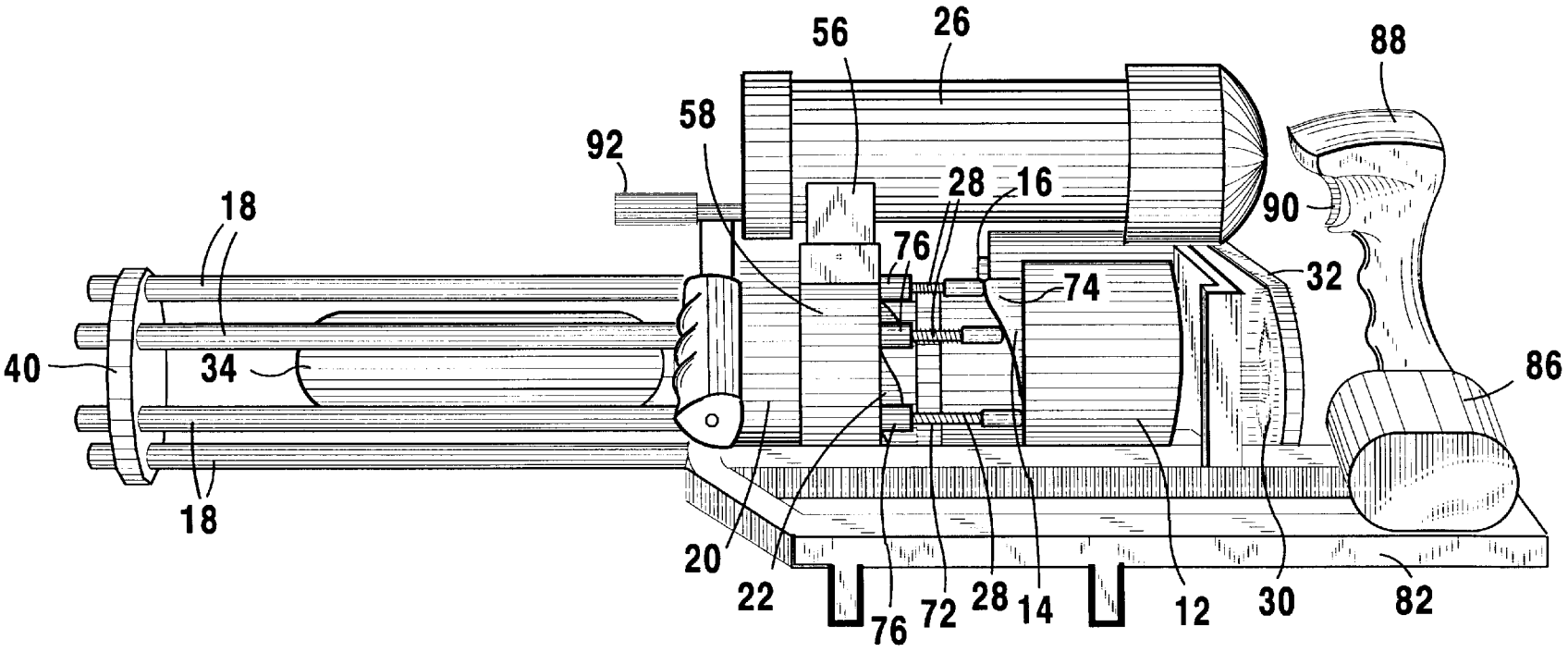
FIG. 6 is a top perspective view of the multi-barreled rapid fire BB gun of the present invention.
Figure 7A:
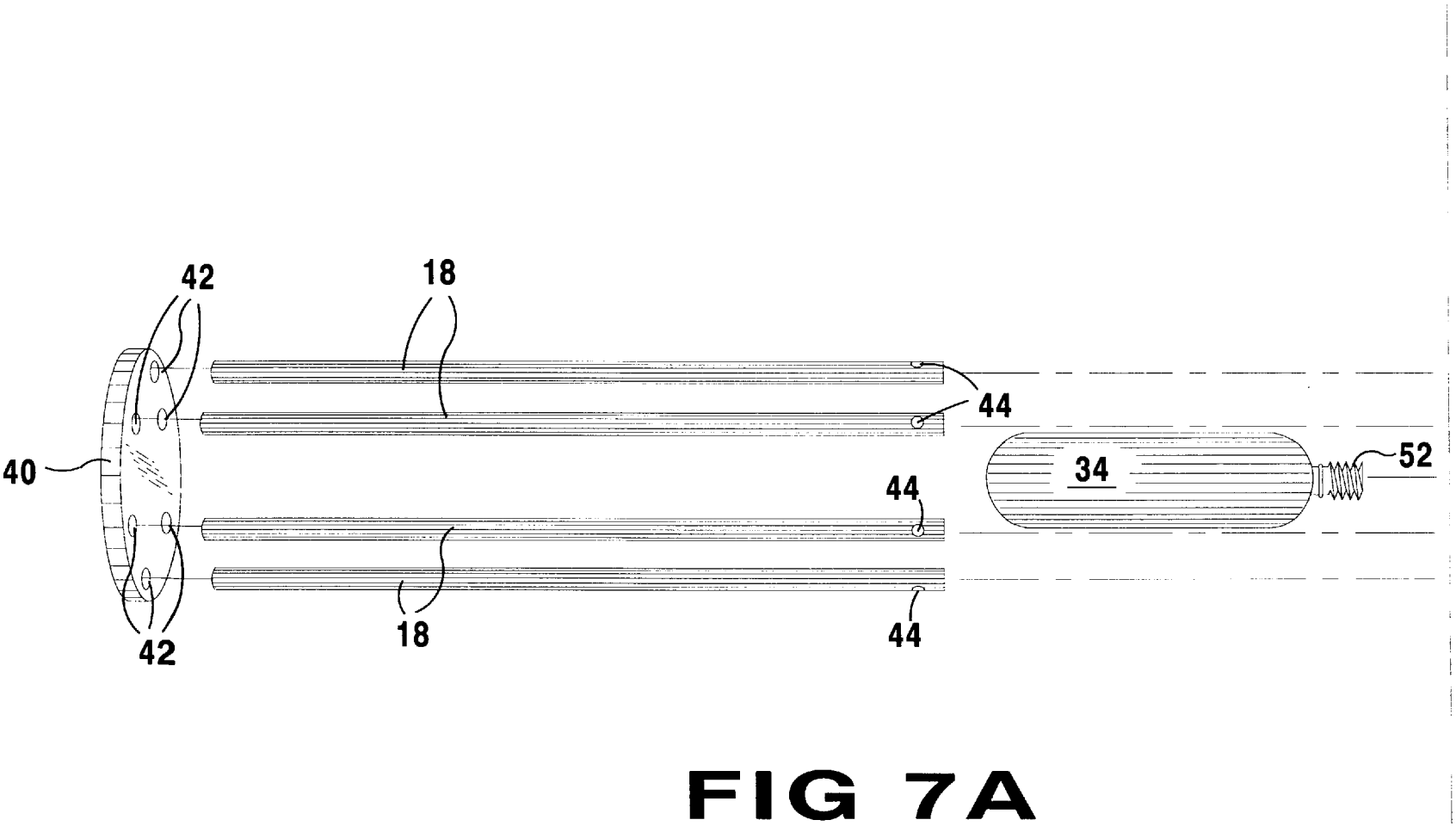
FIGS. 7A–7C show an exploded view of the multi-barreled rapid fire BB gun of the present invention.
Figure 7B:
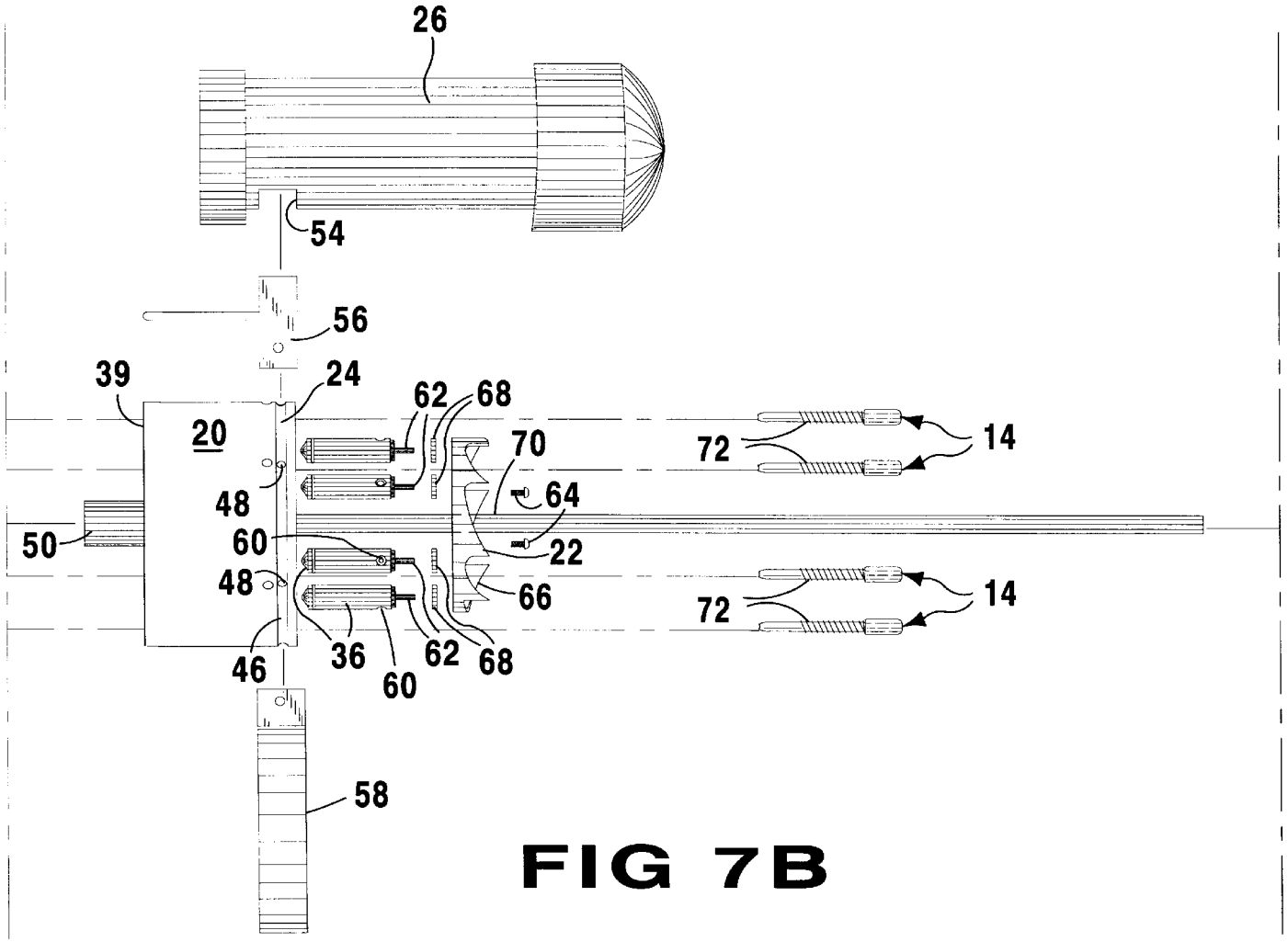
Figure 7C:
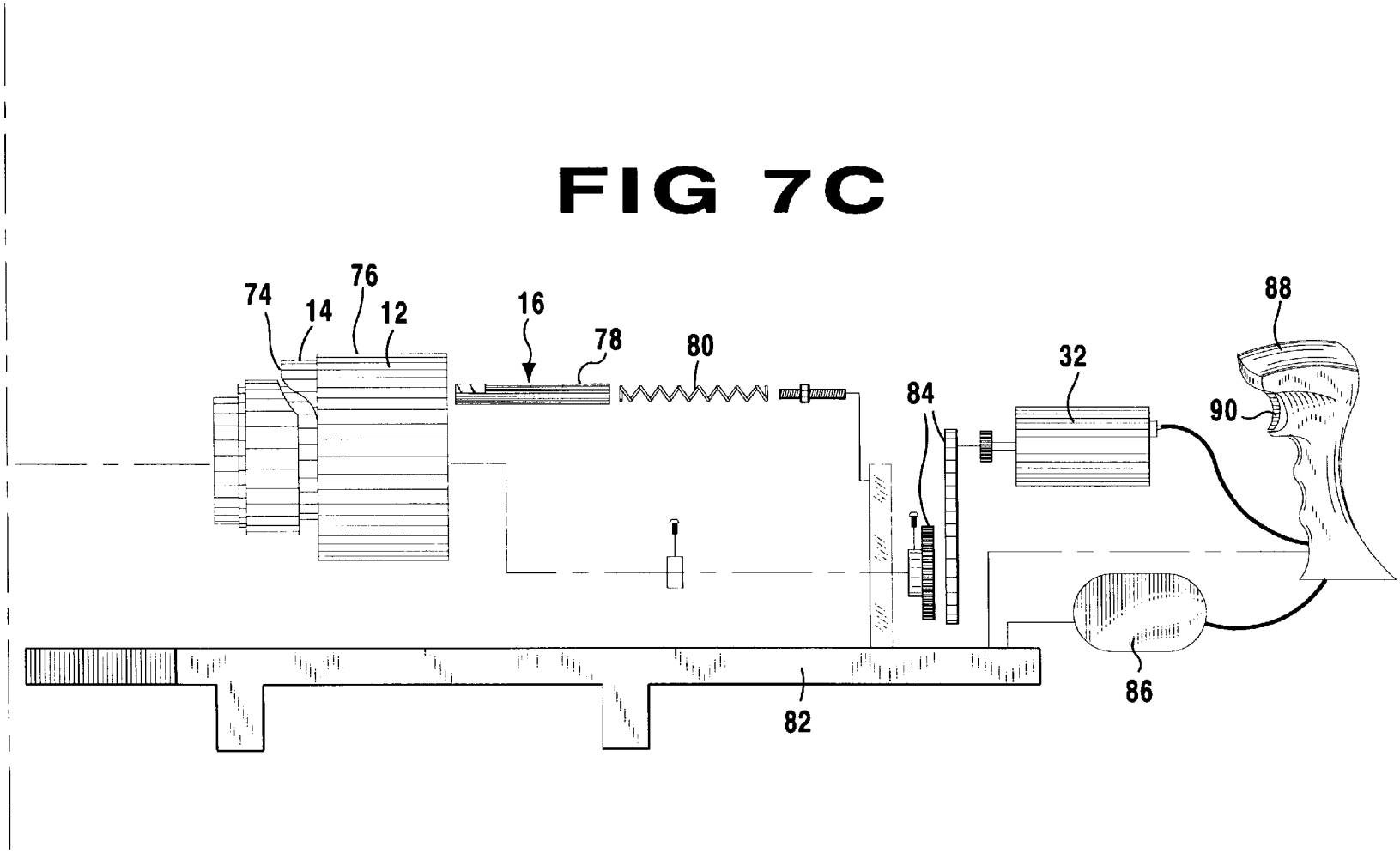

A perspective view of the multi-barreled rapid fire BB gun 10 is illustrated in FIG. 6 with an exploded view thereof illustrated in FIG. 7. As can be seen from these figures, the plurality of barrels 18 and the gas supply 34 are connected to extend from a first end 39 of the barrel housing 20. The plurality of barrels 18 are positioned about a periphery of the barrel housing 20 and the gas supply 34 is extends from a central portion of the barrel housing 20 surrounded by the plurality of barrels 18. A barrel alignment plate 40 includes a plurality of recesses 42 extending therethrough, each recess 42 being positioned to receive a respective one of the plurality of barrels 18 for maintaining the alignment of the barrels 18. Each barrel 18 includes a recess 44 extending therethrough providing access to the inside of the barrel for BB's or projectiles to be fired from the multi-barreled rapid fire BB gun 10.

The barrel housing 20 is preferably round and includes the BB feedway 24 extending therearound. The BB feedway 24 is in the form of a groove 46 extending around the circumference of the barrel housing 20 and a plurality of recesses 48 extend therethrough. Each recess 48 is aligned with a respective recess 44 in one of the plurality of barrels 18. Extending from the first end 39 of the barrel housing 20 is an adapter 50 for releasably connecting with the gas supply 34. The gas supply 34 includes a thread 52 extending around one end thereof for mating with an inner side of the adapter 50 to form a substantially airtight releasable seal therewith.

The BB canister 26 is positioned above the barrel housing 20 and includes a passageway 54 through which BB's may exit the canister 26. Extending from the passageway 54 is a BB guide block 56 for directing the BB's exiting the canister 26 into the groove 46. A BB retainer 58 secures the BB guide block 56 and the BB canister 26 to the barrel housing 20 and in position above the groove 46.

A plurality of gas regulators 36 extend into a second end 49 of the barrel housing 20 and communicate with the gas supply 34. Each gas regulator 36 includes a recess 60 extending therethrough and aligned with the recess 44 of a respective one of the barrels 18 for supplying the gas therethrough and into the barrel 18 with which it is aligned. On one end of each of the plurality of gas regulators 36 is a gas release button 38 for releasing the gas from the gas supply 34 and into the gas regulator 38.

The striker cam 22 is also connected to the second end 49 of the barrel housing 20. A plurality of screws 64 may be used to form the connection and hold the striker cam 22 in position. The striker cam 22 includes a plurality of recesses 66 extending through a periphery thereof. The plurality of gas release buttons 38 each extend through a respective one of the recesses 66. A washer 68 may be positioned between the gas regulators 36 and a respective one of the recesses 66. A recess 70 is also positioned to extend through a central portion of the striker cam 22 for receiving the drive shaft 30 connected to the rotational drive source 32. The drive shaft 30 is connected to the barrel housing causing the barrel housing 20 to rotate therewith.

A plurality of BB bolts 28 are positioned between the barrel housing 20 and the striker housing 12. Each BB bolt 28 is aligned with and extends into a respective one of the plurality of barrels 18. The BB bolts 28 thus rotate with the barrel housing 20 and barrels 18. Each of the BB bolts 28 include a spring 72 positioned therearound allowing for extension and retraction of the respective BB bolt 28 during rotation. An opposing end of each BB bolt 28 contacts the striker housing 12. Extending from the striker housing 12 and providing the surface on which the BB bolts contact and traverse is the BB bolt cam 14. The BB bolt cam 14 is a flat sheet including a humped somewhat bell shaped curve 74 positioned at a top side 76 of the striker housing 12. Thus, when one of the BB bolts 28 rotates to the top of the hump 74, the BB bolt 28 rides along the hump 74 and is caused to extend into the barrel 18 with which it is aligned positioning its magnetic end below the recess 48 in the passageway 24 causing a BB to be pulled into the barrel 18. A spring adjustment regulator 76 is positioned on an end of each of the BB bolts 28 causing the spring 72 on the respective BB bolt 28 to coil when the BB bolt 28 is caused to extend into the barrel 18. The spring adjustment regulator 76 regulates the tension of the spring 72 and allows the spring 72 to return to its original position after the BB bolt 28 is removed from the barrel 18 and passes over the hump 74.

The striker cam 22 is attached to the barrel housing 20 but does not rotate therewith. The striker cam 22 is a round plate including a plurality of saw tooth projections 78 extending from a periphery thereof and towards the striker housing 12. One saw tooth projection 78 is provided for each BB bolt 28. The BB bolts 28 are caused to ride over the saw tooth projections 48 as they rotate. As the BB bolts 28 ride over the top of one of the saw tooth projections 78 the spring 72 is caused to coil thereby loading the BB bolt 28. When passing over the saw tooth projection 78 immediately prior to the firing position the BB bolt is caused to recoil activating the striker 16 to fire and activate the gas release button 38. The striker 16 includes a projectile 78 and a spring 80 whereby when triggered, the spring 80 recoils causing the projectile 78 to project towards the gas release button 38 and upon contact with the gas release 38 of the gas regulator 36 causes gas to be supplied to the barrel 18 aligned therewith and containing a BB positioned therein. The contacting of the gas release button 62 causes gas to be delivered at a pressure regulated by the gas regulator 36 and thereby ejecting the BB through the barrel 18.

The rotational drive source 32 is attached to a frame 82 and located on a side of the striker housing 12 opposite the barrel housing 20. The rotational drive source 32 is connected to a pulley drive 84 causing it to rotate. The pulley drive 84 is connected to the drive shaft 30 imparting a rotational movement thereto and causing the barrel housing 20 and all elements connected thereto to rotate. A power source 86 is also connected to the frame 82 and provides power to drive the rotational drive source 32.

A handle 88 is connected to the frame 82 adjacent the rotational drive source 32 for use in controlling the position and aiming of the multi-barreled rapid fire BB gun 10. Positioned on the handle 88 is a trigger 90. The trigger 90 is connected between the power source 86 and the rotational drive source 32 whereby when the trigger 90 is activated, the power source 86 is connected to provide power to the rotational drive source 32 causing the rotational drive source 32 to turn the drive shaft 30 and thus the barrel housing 20 to align the next barrel and BB bolt in firing position, causing a BB to be received by the barrel 18. When the trigger 90 is activated, the striker 16 is caused to press the gas release button 38 causing gas to be delivered from the gas supply 34 to the barrel 18 at a pressure determined by the gas regulator 36 causing the BB to be fired or ejected from the barrel 18 at a force determined by the gas pressure. A sight 92 is connected to the frame 82 and extending over the barrels 18 for use in aiming the multi-barreled rapid fire BB gun 10.

Figure 2:
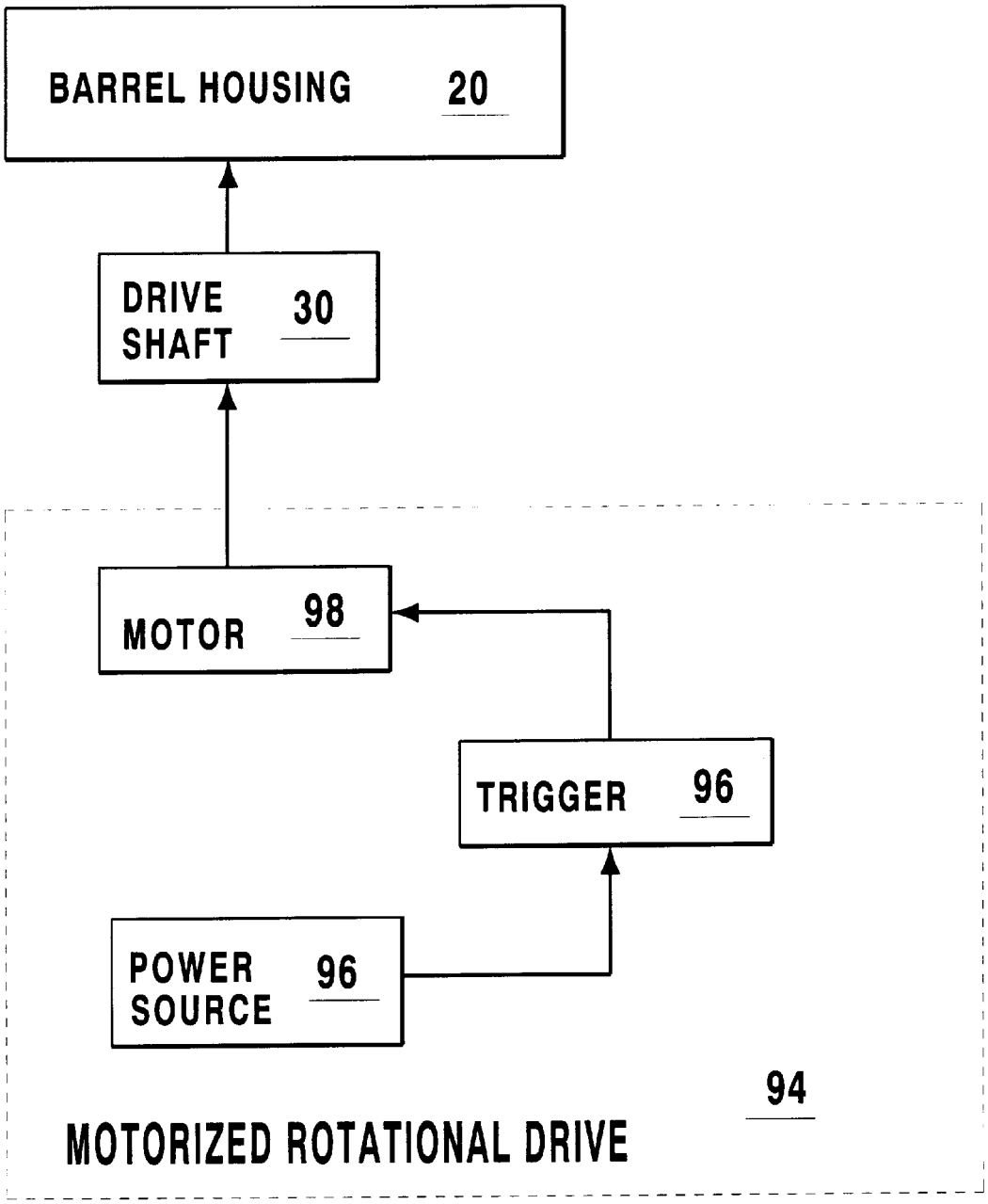
FIG. 2 is a block diagram of the means for supplying the rotational drive to the drive shaft of the multi-barreled rapid fire BB gun of the present invention.

A block diagram of the motorized rotational drive 32 is illustrated in FIG. 2. This figure shows the motorized rotational drive 32 using the trigger 90 to connect the motor 32 to the power source 86 in order to rotate the drive shaft 30. When the trigger 90 is activated by a user such as when firing the multi-barreled rapid fire BB gun 10, power is supplied to the motor 32 causing the motor 32 to rotate the drive shaft 30 and thereby rotate the barrel housing 20 connected thereto. Rotation of the barrel housing 20 causes a barrel adjacent to the barrel 18 through which a BB was just fired to move into alignment with the firing position. Each time the trigger 90 is activated, a BB will be fired through the aligned barrel 18 and an adjacent barrel 18 will be moved into the firing position.

Figure 3:
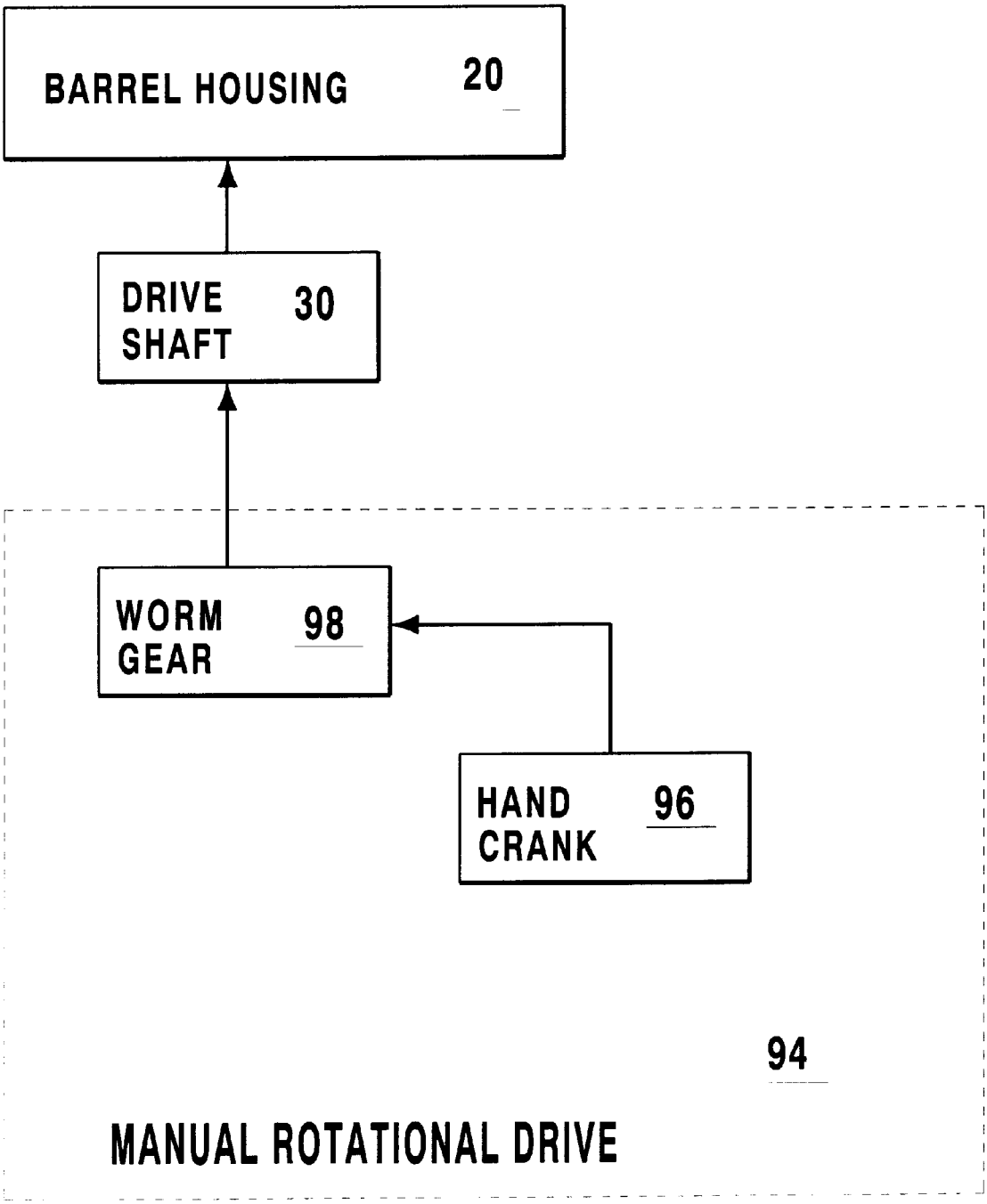
FIG. 3 is a block diagram of a manual rotational drive of the multi-barreled rapid fire BB gun of the present invention.

A block diagram of a manually activated rotational drive unit 94 is illustrated in FIG. 3. The manual rotational drive 94 includes a hand crank 96 connected to a worm gear 98. The worm gear 98 is connected to the drive shaft 30 which is in turn is connected to the barrel housing 20. When a user turns the hand crank 96, the worm gear 98 is caused to turn. The worm gear 98 turns the drive shaft 30 and thus turns the barrel housing 20.

Figure 4:
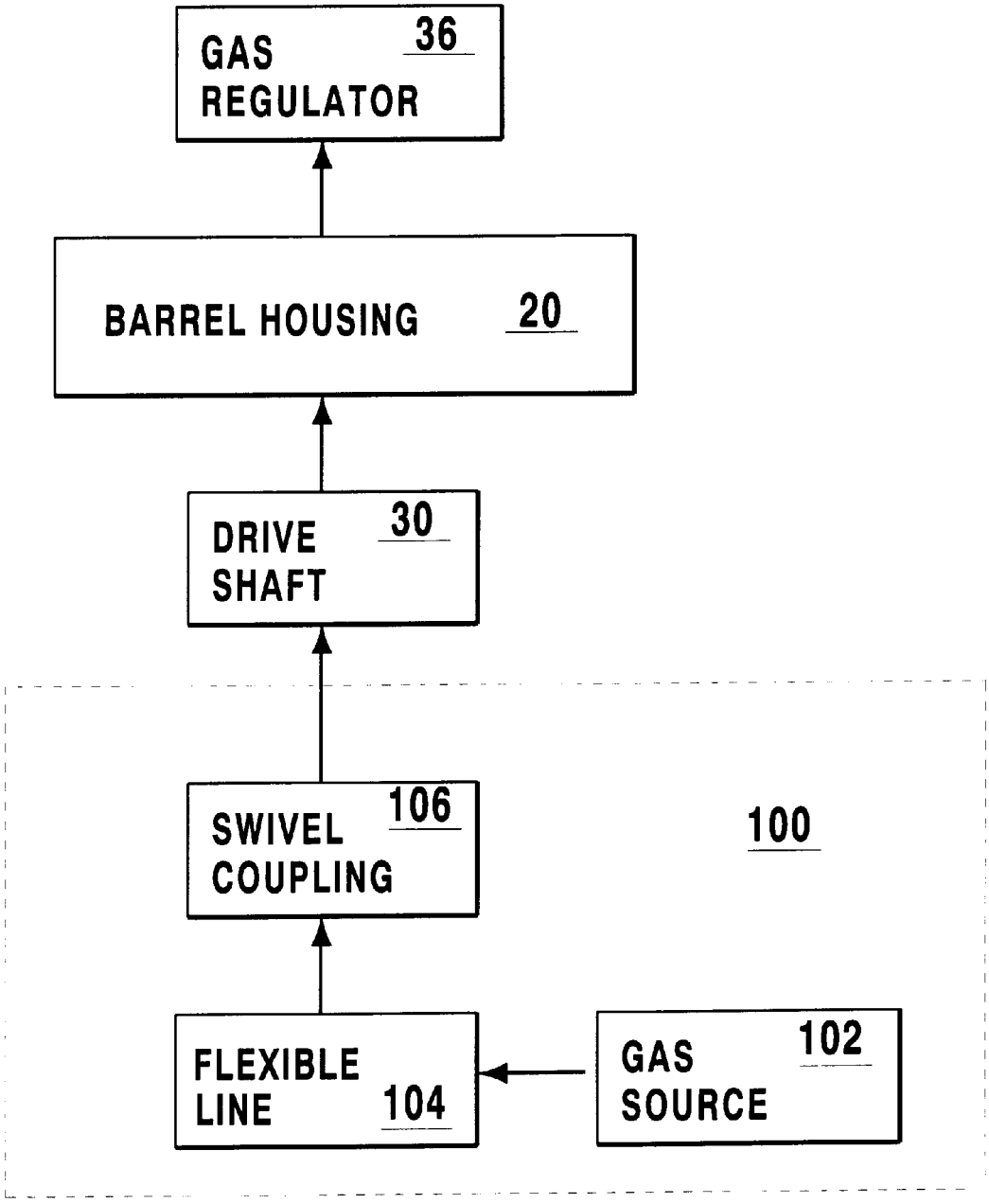
FIG. 4 is a block diagram of the device for supplying a propellant to the gas regulators of the multi-barreled rapid fire BB gun of the present invention, the supply of propellant having an unlimited capacity.

FIG. 4 is a block diagram of an unlimited propellant supply 100 for powering the multi-barreled rapid fire BB gun 10. The supply 100 includes a source of gas 102 which may be from a large tank or connected to a gas line having an unlimited or very large capacity. Use of such a supply will increase the range of the multi-barreled rapid fire BB gun 10 while also increasing the number of rounds which may be fired between adjustments of the multi-barreled rapid fire BB gun 10 and refilling of the gas supply 34. The gas source 102 is coupled to a flexible line 104 for transporting the gas to the multi-barreled rapid fire BB gun 10. A swivel coupling 106 couples the flexible line to the multi-barreled rapid fire BB gun 10 and provides the supply of gas along the drive shaft 30 and to the barrel housing 20 in which it is delivered to the gas regulator 36. When the trigger 90 is activated or the hand crank 96 is turned, the gas regulator is caused to release an amount of gas into the barrel 18 causing the BB positioned therein to be projected from the barrel at a target. A multi-barreled rapid fire BB gun 10 including such a supply has limited mobility but a much greater range than a multi-barreled rapid fire BB gun 10 having a more mobile gas supply.

Figure 5:
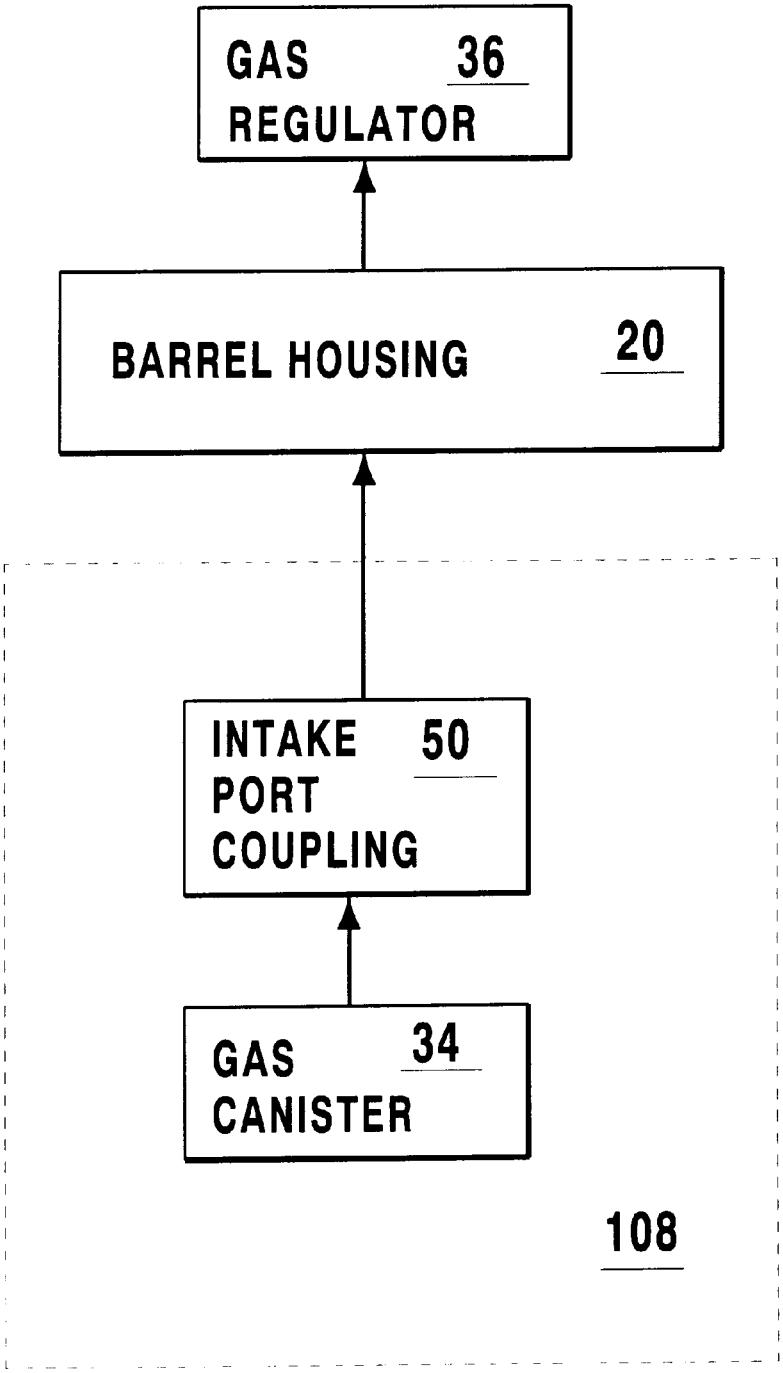
FIG. 5 is a block diagram of an alternate device for supplying a propellant of limited supply to the gas regulators of the multi-barreled rapid fire BB gun of the present invention.

A more mobile gas supply is illustrated in block diagram form in FIG. 5. This supply is illustrated throughout the figures and includes the gas canister 34 which is coupled to the intake port coupling or adapter 50. The adapter 50 is connected to the barrel housing 20 which supplies the gas received from the adapter 50 to the gas regulator. When the trigger 90 is activated or the hand crank 96 is turned, the gas regulator is caused to release an amount of gas into the barrel 18 causing the BB positioned therein to be projected from the barrel at a target.

The operation of the multi-barreled rapid fire BB gun 10 will now be described with reference to the figures. In operation, the multi-barreled rapid fire BB gun 10 is grasped by a user and a gas supply 34 is connected to the adapter 50. A canister 26 filled with a projectile is then secured atop the barrel housing 20 by the retainer with the guide block positioned to extend from the passageway in the canister 26 to the feedway 24. The gas pressure is then set on the gas regulator 36 and the power source 92 is connected to the rotational drive source if a motorized drive is being used. The multi-barreled rapid fire BB gun 10 is now ready for use.

The user will now grasp the multi-barreled rapid fire BB gun by the handle 90 and adjust the scope 92 prior to firing a projectile therefrom. The user will then aim and either activate the trigger 88 or turn the hand crank 102. Activation of the trigger 88 and turning of the hand crank 102 causes the drive shaft 30 to turn. The drive shaft in turn will cause the barrel housing 20 to turn and thus the barrels 18 will turn. As the barrel housing turns the bolts 28 are caused to travel around the periphery of the bolt cam 14. As one of the bolts 28 reaches the hump of the bolt cam 14 it is caused to extend into the barrel 18 aligned therewith. This causes the magnetic portion of the bolt 28 to extend toward an aligned recess of the feedway 24 and thereby draw a projectile into the barrel. As the bolts 28 continue to rotate, they pass over the saw tooth projections extending from the striker cam causing the striker to be activated and thereby activate a gas release button 38. Activation of the gas release button 38 causes the gas regulator 36 to deliver a supply of pressurized gas from the gas supply to the barrel causing the projectile within the barrel to be ejected therefrom. The velocity of the projectile and distance it travels is determined by the preset pressure of the gas. As the trigger is continually pressed or even held or as the hand crank 102 is turned the process repeats as the drive shank and barrel housing are continually turned. This will continue as long as the supply of gas provides a sufficient amount of gas pressure to the projectile. When the gas supply is low, the gas tank must be changed and the process can continue.

Throughout the description the present invention has been described as projecting BB pellets through the barrels. In practice any type of projectile may be ejected through the barrels as long as the projectile is of a size slightly smaller than the internal circumference of the barrels. Furthermore, no specific type of gas was disclosed as the gas supply. In use any type of gas may be used to eject projectiles from within the barrels. The pressure that the gas is placed under is the critical factor in determining the distance or range of the multi-barreled rapid fire BB gun 10 and the number of rounds the multi-barreled rapid fire BB gun 10 will be able to fire before replenishing the supply of gas.

From the above description it can be seen that the multi-barreled rapid fire BB gun of the present invention is able to overcome the shortcomings of prior art devices by providing a multi-barreled rapid fire BB gun which is able to use a gas supply for propelling the BB's from the gun. The multi-barreled rapid fire BB gun able to simulate the look and feel of either a mini-gun or a gattling gun when propelling the BB's using the supply of gas and can be used for hunting or targeting. The multi-barreled rapid fire BB gun also includes a device for adjusting the force at which the projectile is ejected from the gun. Furthermore, the multi-barreled rapid fire BB gun of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A multi-barreled rapid fire gun for firing a plurality of projectiles from a supply of said projectiles contained within a container releasably connected to the gun, said multi-barreled rapid fire gun comprising:

a) means for receiving said projectiles from said supply;

b) a supply of gas;

c) means for providing said gas to said receiving means;

d) means for regulating a pressure of said gas supplied to said receiving means wherein activation of said means for providing causes said gas to be supplied to said receiving means at a desired pressure causing said projectile to be ejected from said receiving means, a velocity at which said projectile is ejected and a distance at which said projectile travels being dependent upon the pressure at which the gas is provided to the receiving means;

e) said receiving means including a plurality of barrels and further comprising means for rotating said plurality of barrels wherein each barrel receives a projectile to be ejected therefrom from said supply of projectiles upon each revolution; and e) each of said barrels includes a recess extending therethrough and said means for rotating includes a feedway extending therearound and a plurality of recesses extending through the feedway whereby each feedway is aligned with said recess in a respective one of said plurality of barrels, wherein said projectiles are received by said feedway and delivered to each of said barrels through said recess in said feedway and said recess in said barrel.

2. The multi-barreled rapid fire gun as recited in claim 1, further comprising a plurality of bolts each bolt being aligned with a respective one of said barrels, wherein as each of said barrels are rotated into a firing position, said respective bolt is caused to extend into said barrel and draw a projectile through said recess in said feedway and said recess in said barrel.

3. The multi-barreled rapid fire gun as recited in claims 2, wherein an end of plurality of bolts which extends into said barrel includes a magnetic material and said projectiles are made of a metallic material whereby when said magnetic end of each bolt extends into said respective barrel, a projectile is drawn into said barrel by magnetic attraction.

4. The multi-barreled rapid fire gun as recited in claim 3, further comprising means positioned around said means for rotating for retaining said projectiles in said feedway.

5. The multi-barreled rapid fire gun as recited in claim 1, wherein said means for rotating includes a motor, a drive shaft extending from and rotated by said motor and a barrel housing connected to rotate with said drive shaft, said plurality of barrels being connected to extend from said barrel housing.

6. The multi-barreled rapid fire gun as recited in claim 5, further comprising a trigger connected between said motor and a power supply, wherein said trigger connects the power supply to said motor when activated.

7. The multi-barreled rapid fire gun as recited in claim 1, wherein said means for rotating includes a hand crank, a worm gear connected to and rotated by said hand crank, a drive shaft extending from and connected to rotate with said worm gear and a barrel housing connected to rotate with said drive shaft, said plurality of barrels being connected to extend from said barrel housing.

8. The multi-barreled rapid fire gun as recited in claim 1, wherein said gas supply is a canister connected to said means for providing.

9. The multi-barreled rapid fire gun as recited in claim 1, wherein said plurality of projectiles are BB pellets.

10. The multi-barreled rapid fire gun as recited in claim 1 further comprising a handle for use in holding the gun and aligning the gun for firing.

11. The multi-barreled rapid fire gun as recited in claim 1, further comprising a scope for aiming the gun at a target prior to firing.

12. A method of ejecting a projectile from a multi-barreled rapid fire gun comprising the steps of:

a) providing said projectile to a barrel of the gun by rotating a feedway positioned at a passageway of a canister retaining projectiles therein, supplying a plurality of projectiles to the feedway, and supplying a projectile to each of a plurality of barrels rotating with the feedway as each barrel passes directly below the canister retaining the projectiles therein;

b) positioning the projectile within the barrel;

c) activating a gas release button; and d) supplying an amount of gas to the barrel at a predetermined pressure causing the projectile to be ejected from the barrel, a velocity at which the projectile travels and a distance traveled by the projectile being dependent upon the pressure at which the gas is supplied to the barrel.

13. The method as recited in claim 12, wherein said step of supplying further comprises the step of inserting a bolt into each barrel as the barrel passes below the canister causing a projectile in the feedway to be drawn into the barrel via magnetic attraction.

14. The method as recited in claim 12, wherein said step of rotating is automatically performed by a motor.

15. The method as recited in claim 12, wherein said step of rotating includes the step of manually turning a hand crank.

16. The method as recited in claim 12, wherein said projectiles are retained within the feedway while the feedway is rotating by a projectile retainer positioned to cover the feedway.

17. The method as recited in claim 12, further comprising the step of activating a striker for releasing the gas from the gas supply when one of the barrels receives a projectile therein.

* * * * *